US005336379A

United States Patent [19]

Chung et al.

[11] Patent Number: 5,336,379

[45] Date of Patent: Aug. 9, 1994

[54] PHOTOELECTRO-CHEMICAL ETCHING METHOD AND APPARATUS OF COMPOUND SEMICONDUCTOR

[75] Inventors: Ji H. Chung; Jai K. Wee; Doo H. Lee; Sang G. Byeon, all of Seoul, Rep. of Korea

[73] Assignee: Hyundai Electronics Industries Co., Ltd., Kyoungki-Do, Rep. of Korea

[21] Appl. No.: 963,373

[22] Filed: Oct. 20, 1992

[51] Int. Cl.[5] ..... C25F 3/12; C25F 7/00

[52] U.S. Cl. ..... 204/129.3; 204/129.4; 204/129.43; 204/DIG. 9; 204/224 M

[58] Field of Search ..... 204/129.3, 129.75, 224 M, 204/129.4, 129.43, DIG. 9; 156/DIG. 80

[56] References Cited

U.S. PATENT DOCUMENTS 4,369,099 1/1983 Kohl et al. ..... 204/129.3
4,384,198 5/1983 Williamson ..... 250/203 R
4,482,443 11/1984 Bacon et al. ..... 204/129.75 X
4,608,138 8/1986 Kobayashi ..... 204/129.3
4,622,114 11/1986 Glass et al. ..... 204/129.3

FOREIGN PATENT DOCUMENTS 61-125134 6/1986 Japan .

*Primary Examiner*—Donald R. Valentine
*Attorney, Agent, or Firm*—David M. Klein

[57] ABSTRACT

The photoelectro-chemical etching system of compound semi-conductor is disclosed. The system comprises a laser generator, a shutter to cut off laser beam, a laser beam chopper, a secondary high reflection mirror, a beam expander, a waveform generator, a chopper controller, a potentiostat to apply the reverse or forward voltage to the optical glass cell. Instead of applying the reverse-bias voltage to a semiconductor material, the reverse and/or forward voltage with a uniform pulse period is applied so that homogeneous and damage-free surface is obtained and etching process is made available in a more efficient manner.

8 Claims, 2 Drawing Sheets

PHOTOELECTRO-CHEMICAL ETCHING METHOD AND APPARATUS OF COMPOUND SEMICONDUCTOR

BACKGROUND OF THE INVENTION

1. Field of the Invention

This invention relates to the photoelectro-chemical etching system of compound semiconductor, which is employed to achieve an etch at high rate and enable the homogeneous surface of the semiconductor after etching, by modulating appropriately both the waveform period of laser beam used as an optical source and the waveform of voltage applied to semiconductor material imbedded in etchant solution. It especially relates to system of this kind which is applicable in forming the diffraction lattice in photoelectro-chemical laser holography in line with the manufacture of optical elements such as DFB semiconductor lasers and Bragg reflector semiconductor lasers, and extensively to a method used in treating the surface of compound semiconductor material in an efficient manner.

2. Description of the Prior Art

In general, the photoelectro-chemical etching method using lasers, which is a novel technology that can selectively etch the desired parts without using a mask, is extensively used for manufacturing such optical elements as LED(Light Emitting Diode), long wavelength mesh p-i-n photodetector, and millimeter wave electro-oscillator. The following is a summary and some disadvantages as to when the diffraction lattice in laser holography is photoelectro-chemically formed on the surface of the compound semiconductor. In the prior art, a sufficiently large reverse voltage during the etching process must be applied so as to stimulate the oxidation reaction of semiconductor material deposited in etchant solutions. As the etching proceeds, many holes under the reverse-bias condition are induced on the surface of n-type compound semiconductor and this is further facilitated by the illumination of lasers. In a photo-chemical reaction between lasers and etching solutions, the semiconductor material is positively ionized so that some by-products generated from the process are deposited into the etchant solutions. In this case, a majority of by-products are present on the surface of the material in hydroxide, or form some layers in liquid by bonding with negative ions of etchant solutions near the surface of the semiconductor. If the layers of by-product formed during the etching process are above certain thickness, they act as optical waveguide and with the illumination of laser, and the incident light is absorbed into the layers which gives rise to oscillation and reflection. This degrades the intensity of lasers and the undesired parts are hence etched. Also, as the refractive index in layers of by-product differs from that of the etchant solution, the incident light will cause the change of incidence angle, thus affecting the spacing when the diffraction lattice using a holography is to be manufactured. After completion of the etching process, the surface of the semiconductor materials becomes toughened due to the etching of undesired parts, which leads to reduction of the efficiency of the manufactured diffraction lattice.

It is a principle object of the present invention, therefore, to provide the photoelectro-chemical etching system of compound semiconductor, visualizing more efficient etching process than heretobefore available, the above-said objective should be construed as only one of many possible through the utilization of a few of the more practical and important features and applications of the invention. Many other beneficial results can be obtained by applying the disclosed invention in a different manner or modifying the invention within the scope of the disclosure. Accordingly, other objectives and a fuller understanding of the invention may be had by referring to both the summary of the invention and the detailed description, below, which describe the preferred embodiments and describe the scope of the invention defined by the claims, whose summary and description should be considered in conjunction with the accompanying drawings.

SUMMARY OF THE INVENTION

For the purpose of summarizing the invention, an embodiment of the invention relates to a electro-chemical etching system of compound semiconductor, wherein, instead of applying the reverse-bias voltage to a semiconductor material, the reverse and/or forward voltages with a uniform pulse period is applied to a semiconductor material using a waveform generator.

When the reverse-bias voltage is applied, the etching process by oxidation reaction, as stated in the above, proceeds to form the layers of by-product near the surface of the material.

When the forward-bias voltage is applied, electrons are induced on the surface of a material and the layers of by-product in deoxidation reaction is diffused away from the surface.

For more efficient etching process, in addition to the above, a laser beam chopper to break off the light of lasers is radiated during the etching process, and is thus used to correspond the pulse period of a pulse generator to the on-off period of laser beam. Also, some important parameters such as the size of reverse and/or forward voltages applied to a material from a waveform generator and pulse period (including a period of laser beam chopper) must be determined in accordance with a compound semiconductor material to be etched and its related kinds of etchant solutions as well as kinds and intensity of laser.

The electro-chemical etching system of compound semiconductor in accordance with the present invention comprises of the following; a shutter to cut off the light emitted from laser generator; a laser beam chopper to break off the light through said shutter; a secondary high reflection mirror to emit the light being broken off through said laser beam chopper; a beam expander to expand the light from said secondary high reflection mirror; a waveform generator to generate a waveform; a chopper controller to control said laser beam chopper, being connected between said laser beam chopper and said waveform generator; a potentiostat to apply the reverse and/or forward voltages to optical glass cell 13 by corresponding to pulse signals received from said optical glass cell 13, being connected between said optical glass cell and said waveform generator 17. To make the description more clear, reference is made to the attached drawings of the present invention below.

The more practical and important features of the present invention have been outlined above in order that the detailed description of the invention which follows will be better understood and that the present contribution to the art can be fully appreciated. Additional features of the invention described hereinafter also form the subject matter of the claims of the invention. Those skilled in the art can appreciate that the conceptions and the specific embodiments disclosed herein may be readily utilized as bases for modifying or designing other structures for carrying out the same purposes as those of the present invention. Further, those skilled in the art can realize that such modified or newly-designed other structures do not depart from the spirit and scope of the invention as set forth in the claims.

BRIEF DESCRIPTION OF THE DRAWINGS

For a fuller understanding of the nature and objectives of the invention, reference should be made to the following Detailed Description of the Invention in conjunction with the accompanying drawings, a brief description of which drawings follow.

Figure 1:
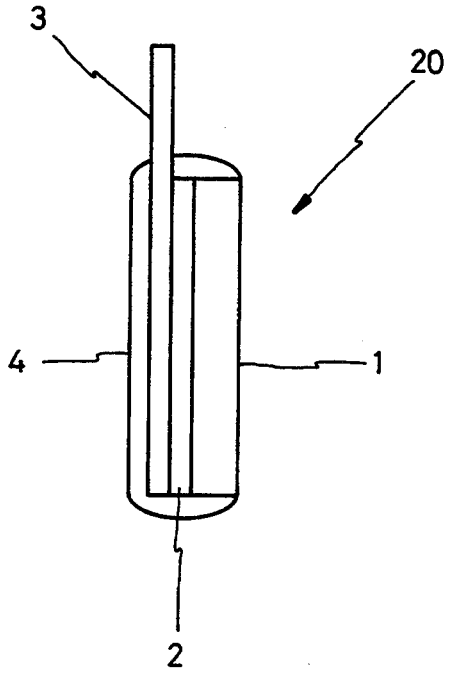
FIG. 1 is a plan view of compound semiconductor sample.

The respective reference numerals noted in the detailed description of the invention below refer to the respective reference numerals relating to the pertinent drawing parts and found as applicable throughout the several views of the drawings.

DETAILED DESCRIPTION OF THE INVENTION

Figure 2:
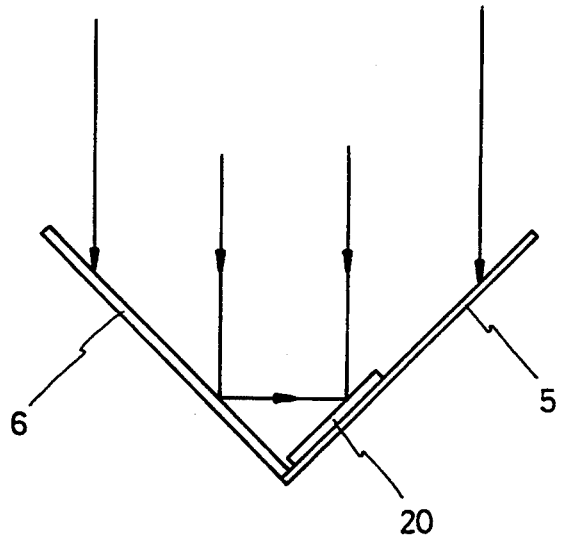
FIG. 2 is a view of formation of the diffraction lattice.

A plan view of the compound semiconductor sample is shown in FIG. 1. It consists of an ohmic contact 2 to apply the voltages to the rear side of compound semiconductor material 1 which will be etched, and a copper strip 3 will then be attached. Except for the front area where a diffraction lattice will be formed, the remaining parts are coated with an organic substance 4 in order to protect them from the etchant solutions. The sample manufactured herefrom is attached to a glass plates of sample block, in which a primary high reflection mirror 6 and glass plate 5 are at right angles as illustrated in FIG. 2.

When the expanded incident light enters the sample block, two parts of the laser beam (i.e., one is reflected from the primary high reflection mirror 6 into the semiconductor material while the other accepts the incident light beam directly) intersect on the surface part of the semiconductor material to form a diffraction pattern.

Figure 3:
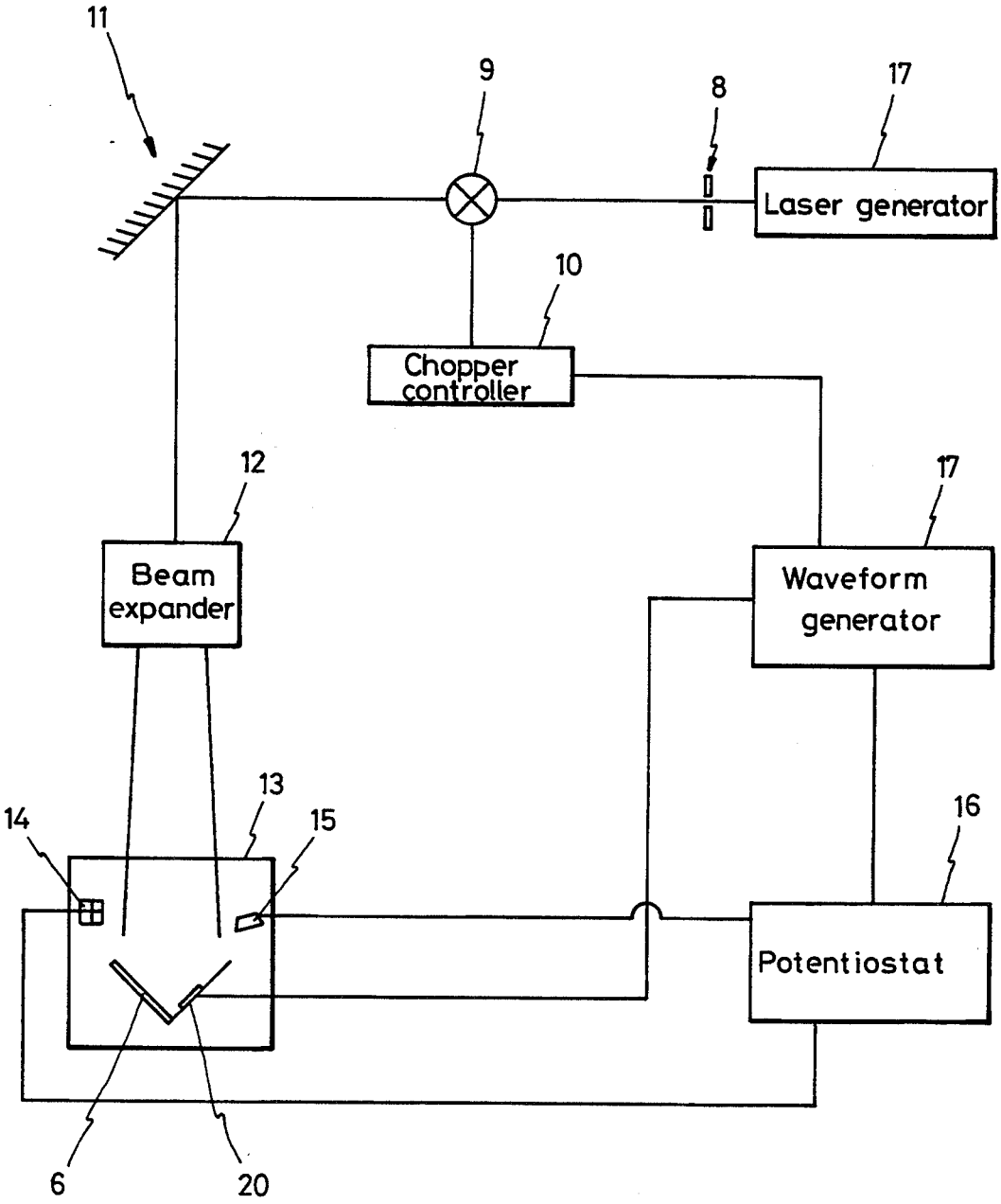
FIG. 3 is a block diagram illustrating an embodiment of photoelectric-chemical etching system.

A block diagram illustrating an embodiment ok photoelectro-chemical etching system is shown in FIG. 3. Through a shutter 8 and a laser beam chopper 9, the lights generated from a laser generator 7 is reflected to the secondary high reflection mirror 11, and is entered into a beam expander 12. Then, the laser beam expanded from a beam expander 12 is infiltrated into optical glass cell 13. Meantime, a chopper controller 10 to control said laser beam chopper is supplied with waveform signal generated from a waveform generator 17. The waveform signal is transferred to a potentiostat 16, where it applies the uniform reverse and forward voltage to glass plate 5, a sliced platinum 14, and a standard calomel electrode 15 installed within optical glass cell 13.

The process of etching a compound semiconductor with the present system is as follows: The formation of diffraction patterns as illustrated in FIG. 2 occurs within optical glass cell 13 containing the etchant solutions. The etching process of the semiconductor at the bright side of the pattern occurs by photo-chemical reaction between etching solution and the laser beam, while the etching is undone at the dark side. The diffraction patterns are thereby introduced into the surface of compound semiconductor 1. In this photo-chemical reaction, the etching process proceeds at a higher rate if an uniform voltage is applied using a potentiostat 16. Hence, waveform generator 17 is provided for applying a reverse and/or forward voltage with a waveform period across the semiconductor material. Waveform generator 17 further controls chopper controller 10 and a laser beam chopper 9. In this manner, the waveform period applied to the compound semiconductor material 1 of sample 20 through potentiostat 16 corresponds with the on-off period of the laser beam.

Then, the lasers will be in on-state when the oxidation reaction(reverse-bias voltage) occurs, while they will be in off-state when the deoxidation reaction(forward-bias voltage) occurs. In comparison to the prior art where some by-products are formed from the continuity of reverse-bias voltage and the illumination of lasers affect the etching process, the present invention enables, when the deoxidation reaction or the laser beam is in off-time state, the layers of by-product to be diffused into the etchant solutions so that the etching process at fresh surface can be initiated from the next on-time state.

The important factors in determining the etching state (i.e., quality of diffraction lattice) are i) the wavelength, intensity, and polarization of a laser generator 7 used as an optical source ii) the selectivity of etchant for a material, iii) the size of applied reverse and forward voltages, and iv) the waveform period.

Both the applied voltages and waveform period of the laser beam, are determined by the rate of oxidation and/or deoxidation reaction occurring in the etching solutions suitable to a material, The reverse and/or forward voltage is preferably about 0.1 to 100 msec and the size of the applied voltage is gauged by the curve of current-voltage characteristics of the semiconductor material 1 occurring in optical glass cell 13.

In treating the surface of compound semiconductor 1, the formation of an oxide layer with homogeneity and good quality is a prerequisite to all manufacturing process. Even though the anodic oxidation method is most widely used to form said oxide film, the thin film oxide layer is hardly obtained by Island Growth Mechanism. To cope with this matter, the present invention has a wide range of application in forming good-quality thin film oxide layers. As described in FIG. 1, the etchant solutions suitable to a particular material is selected after manufacturing sample.

As the etchant solutions greatly affect the chemical composition of the oxide layer to be formed hereafter, the selection should be made by taking the post-surface treatment into due consideration. In the same manner, some important parameters such as the wavelength and intensity of laser beam, including the size and waveform period of applied voltage size, are determined in order to proceed the etching process in accordance with the system illustrated in FIG. 3.

The surface-treatment time, differing for the kinds of material being etched, should be determined by testing. As described in the foregoing, the prior air has recognized disadvantages in that the layers of by-product generated from the etching process are diffused when the forward-bias voltage is applied and in a subsequent processing step, the intensity of laser beam which is diffused by the layers is reduced therefrom and the etching may occur at the undesired parts due to oscillation of optical wave produced from the optical waveguide effects.

The object of the present invention designed to eliminate the disadvantages is to add the periodic waveform to a semiconductor material by dividing the applied voltages into forward and/or reverse ones, which can give an homogeneous, damage-free surface and as a consequence, thereby increasing the efficiency of manufactured diffraction lattices. Also, the etching process is made available in a more efficient manner by corresponding a laser beam with the waveform period of voltages applied to a material.

Although this invention has been described in its preferred forms with a certain degree of particularity, it will be appreciated by those skilled in the art that the present disclosure of the preferred forms has been effected only by way of example, and that numerous changes in the details of the construction, combination and arrangement of parts may be resorted to without departing from the spirit and scope of the invention.

I claim:

1. An system for electro-chemical etching of a compound semiconductor which comprises:

a laser for generating a laser beam as a light source for electro-chemically etching the compound semiconductor;

means for generating a waveform having a period;

a shutter means to cut off the laser beam emitted from the laser generator in accordance with the waveform period;

means for chopping the laser beam to break off laser beam through said shutter;

a secondary high reflection mirror to emit the laser beam being broken off by the laser beam chopper;

means for expanding the laser beam emitted by the secondary high reflection mirror;

a primary reflection means comprising a high reflection mirror and a glass plane on which said compound semiconductor is positioned, said reflection mirror and said glass being disposed adjacent to one another at right angles, the expanded laser beam from the expanding means being directed at the primary reflection means for forming an etching pattern on the surface of the compound semiconductor, the primary reflection means being disposed in an optical glass cell adapted to contain an etching solution;

a control means for controlling said means for chopping the laser beam, said control means being connected between said laser chopping means and said means for generating a waveform; and a potentiostat means comprising electrodes for applying a voltage across the compound semiconductor corresponding to the waveform received from the waveform generator, the potentiostat means being connected to said waveform generating means and across said compound semiconductor, whereby said semiconductor device is etched in accordance with the waveform generated by said waveform generating means.

2. The system according to claim 1 wherein the semiconductor to be etched has at least one exposed surface to be etched, the other surfaces being coated with a protective coating, and the semiconductor adapted for immersion in the etching solution before etching begins.

3. The system according to claim 1 wherein the interrupted laser beam reacts with the etching solution during etching to etch a desired pattern on the semiconductor.

4. The system according to claim 1 wherein the voltage is a forward bias when the laser beam is in an off-state and the voltage is a reverse bias when the laser beam is in an on-state.

5. A method of electro-chemically etching a compound semiconductor which comprises:

generating a laser beam as a light source for electro-chemically etching the compound semiconductor;

generating a waveform having a period;

cutting off the laser beam emitted from the laser generator in accordance with the waveform period;

chopping the laser beam to break off laser beam emitted through said shutter;

expanding the chopped laser beam and directing the expanded laser beam onto a primary reflection mirror, the primary reflection mirror comprising a high reflection mirror and a glass plane on which said compound semiconductor is positioned, said reflection mirror and said glass being disposed adjacent to one another at right angles, the expanded laser beam from the expanding means being directed at the primary reflection means and forming an interference etching pattern on the surface of the compound semiconductor;

applying a voltage across the compound semiconductor corresponding to the waveform received from the waveform generator with a potentiostat, the potentiostat being connected to said waveform generating means and across said compound semiconductor;

whereby said semiconductor device is etched in accordance with the waveform generated by said waveform generating means.

6. The method according to claim 5 wherein the semiconductor has at least one exposed surface to be etched, the other surfaces are coated with a protective coating, and the semiconductor is immersed in the etching solution before etching begins.

7. The method according to claim 5 wherein the interrupted laser beam reacts with the etching solution to etch a desired pattern on the semiconductor.

8. The system according to claim 5 wherein the voltage is a forward bias when the laser beam is in an off-state and the voltage is a reverse bias when the laser beam is in an on-state.

* * * * *

UNITED STATES PATENT AND TRADEMARK OFFICE

CERTIFICATE OF CORRECTION

PATENT NO. : 5,336,379

DATED : August 9, 1994

INVENTOR(S) : Chung, et al

It is certified that error appears in the above-indentified patent and that said Letters Patent is hereby corrected as shown below:

On the title page: Item [30] Foreign Priority Data

October 22, 1991 South Korea 91 18562

Signed and Sealed this

Eighth Day of November, 1994

Bruce Lehman

*Attest:*

BRUCE LEHMAN

*Attesting Officer*

*Commissioner of Patents and Trademarks*